US007311546B2

(12) United States Patent
Itou

(10) Patent No.: US 7,311,546 B2
(45) Date of Patent: Dec. 25, 2007

(54) CONNECTOR, A MATING CONNECTOR AND A CONNECTOR DEVICE

(75) Inventor: Tomonari Itou, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/520,122

(22) Filed: Sep. 13, 2006

(65) Prior Publication Data

US 2007/0059967 A1 Mar. 15, 2007

(30) Foreign Application Priority Data

Sep. 15, 2005 (JP) ..... 2005-268945

(51) Int. Cl.
*H01R 13/648* (2006.01)

(52) U.S. Cl. ..... 439/385

(58) Field of Classification Search ..... 439/382–385
See application file for complete search history.

(56) References Cited

U.S. PATENT DOCUMENTS

| | | | | |
|---|---|---|---|---|
| 3,137,535 | A * | 6/1964 | Collier et al. | 439/350 |
| 3,846,736 | A * | 11/1974 | Muz | 439/553 |
| 4,333,699 | A * | 6/1982 | Brorein | 439/592 |
| 4,449,776 | A * | 5/1984 | Carmo et al. | 439/350 |
| 6,443,764 | B2 * | 9/2002 | Makita | 439/587 |
| 7,104,831 | B2 * | 9/2006 | Fukatsu et al. | 439/385 |
| 7,114,983 | B2 * | 10/2006 | Fukatsu et al. | 439/358 |
| 2001/0041470 | A1 * | 11/2001 | Makita | 439/271 |
| 2003/0036302 | A1 * | 2/2003 | Fukuda | 439/374 |
| 2007/0059967 | A1 * | 3/2007 | Itou | 439/345 |

FOREIGN PATENT DOCUMENTS

| | | |
|---|---|---|
| DE | 8508972 | 5/1986 |
| EP | 1 710 872 A1 | 12/2004 |
| JP | 5-50113 | 3/1993 |
| JP | 2005-174813 | 6/2005 |

* cited by examiner

*Primary Examiner*—Ross Gushi
(74) *Attorney, Agent, or Firm*—Gerald E. Hespos; Anthony J. Casella

(57) ABSTRACT

A holding cap (RC) is mounted on a terminal holding portion (51) of a female housing (5) from the front, and a tubular cover (52) is so formed outward of the terminal holding portion (51) to surround the holding cap (RC). First shake preventing portions (RC3) project radially out from the outer surface of the front end of the holding cap (RC) and second shake preventing portions (52*a*) project in at the rear end of the inner surface of the cover (52). When male and female connectors (1, 4) are connected with each other, the first and second shake preventing portions (RC3, 52*a*) both contact a receptacle (21) of a male housing (2) to reduce the shaking between both housings (2, 5) in transverse directions.

15 Claims, 4 Drawing Sheets

CONNECTOR, A MATING CONNECTOR AND A CONNECTOR DEVICE

BACKGROUND OF THE INVENTION

1. Field of the Invention

The invention relates to a connector, to a mating connector and to a connector device provided with a pair of connectors engageable with each other.

2. Description of the Related Art

Japanese Examined Patent Publication No. H05-50113 discloses a connector assembly with first and second housings that are engageable with each other. A watertight seal is mounted in the first housing, and is held resiliently between the first and second housings and prevents the housings from shaking.

The watertight seal of the above-described connector is resilient and can exert resilient forces to prevent the housing from shaking in a specified manner. However, the flexibility of the watertight seal also can permit shaking if a load on the housings exceeds the forces exerted by the seal.

The invention was developed in view of the above problem and an object thereof is to provide an improved shake preventing function between a connector and a mating connector at the time of engagement.

SUMMARY OF THE INVENTION

The invention relates to a connector that has a housing formed with a receptacle having an open front end. At least one terminal is mounted in the housing and is at least partly surrounded by the receptacle. The housing is connectable with a mating housing of a mating connector. The mating housing has an engaging portion that accommodates at least one mating terminal. The engaging portion of the mating housing can fit into the receptacle of the housing so that the terminals connect with the mating terminals each other. First and second shake preventing portions project from at least one of the housings at an angle to a connecting direction of the housings. The first shake preventing portions extend between the housing and the mating housing near the rear of the receptacle and the second shake preventing portions extend between the housing and the mating housing near the opening of the receptacle. The shake preventing portions reduce transverse shaking between the housings.

The first and second shake preventing portions are parts of at least one of the housings and are not deformed even if an excessive transverse load is applied to either housing.

The leading end of the receptacle preferably is resiliently engageable with the mating connector to reduce shaking between the housing and the mating housing substantially in connecting directions of the housings.

The engaging portion of the mating housing preferably includes a terminal holding portion that is insertable into the receptacle and a covering portion fittable on the outer peripheral surface of the receptacle.

At least one of the shake preventing portions is between the inner peripheral surface of the receptacle and the terminal holding portion and at least one other of the shake preventing portions is between the outer peripheral surface of the receptacle and the covering portion.

A waterproof seal preferably is mounted to the mating housing. A leading end of the receptacle resiliently engages a flexible flange of the waterproof seal and presses the flange backward. The seal reduces shaking between the housing and the mating housing in the connecting directions in addition to displaying a waterproofing function.

An outer diameter of the engaging portion, including the first shake preventing portions, may be slightly larger than the inner diameter of the back side of the receptacle. Thus, the engaging portion preferably is squeezed slightly upon insertion into the receptacle.

An inner diameter of the engaging portion, including the second shake preventing portions, may be smaller than the outer diameter of the receptacle. Thus, the engaging portion preferably is squeezed slightly upon fitting on the receptacle.

The first shake preventing portions and the second shake preventing portions preferably are arranged peripherally at substantially even intervals.

The invention also relates to a connector assembly comprising the above described connector and the mating connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
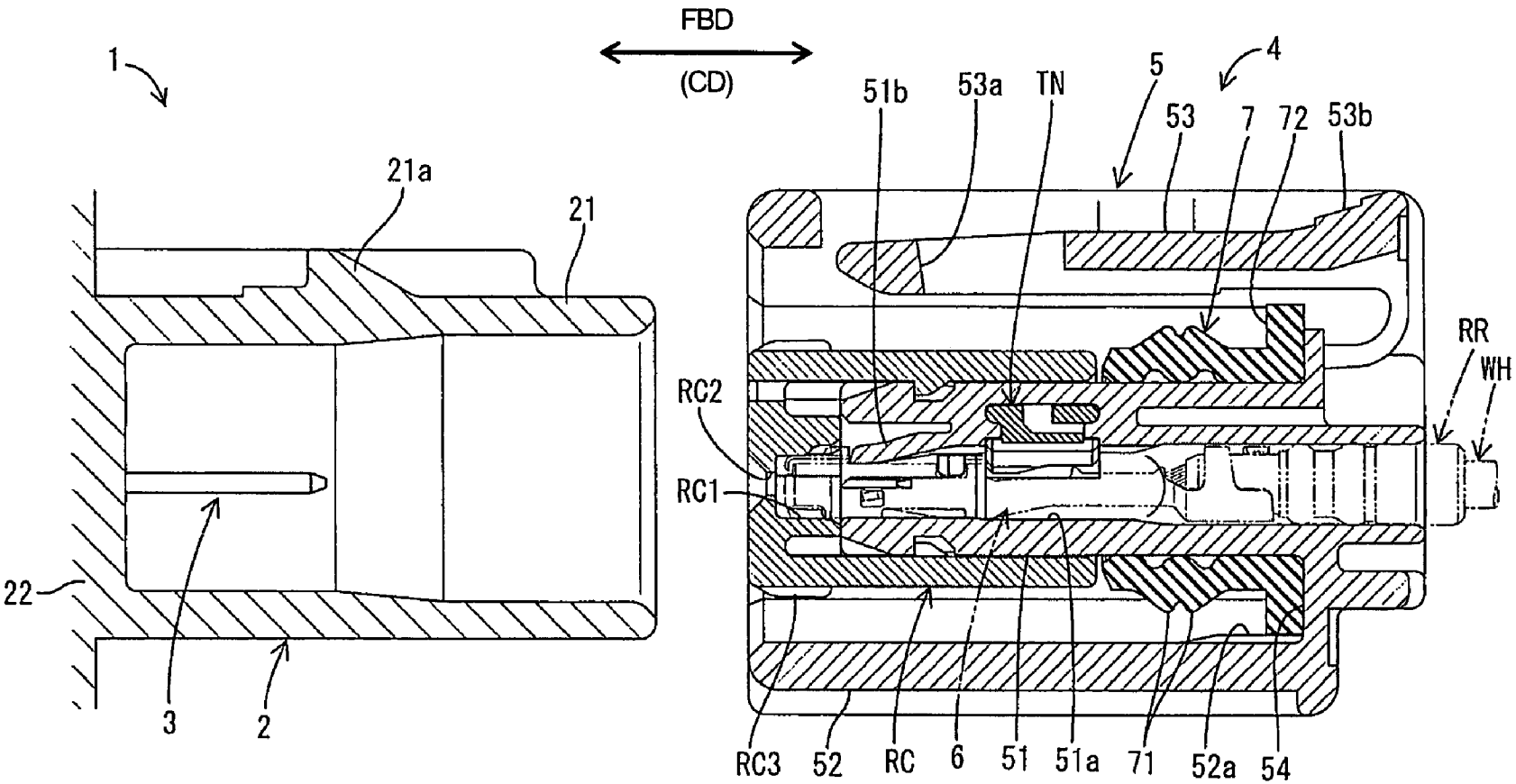
FIG. 1 is a section of male and female connectors according to one embodiment.
Figure 2:
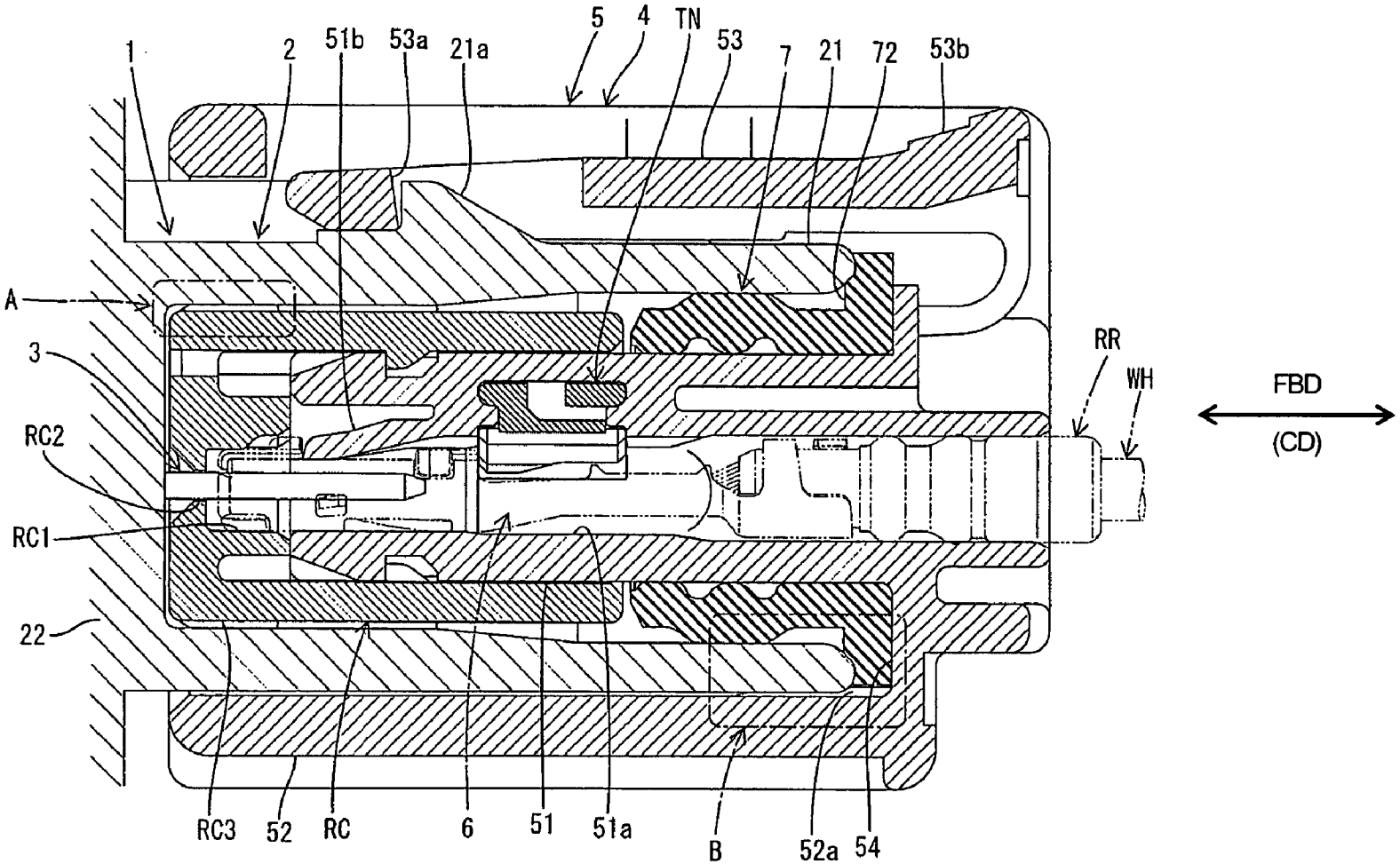
FIG. 2 is a section showing a connected state of both connectors shown in FIG. 1.

A connector assembly according to the invention comprises a male connector identified generally by the numeral 1 in FIGS. 1 to 4. The male connector 1 includes a male housing 2 and male terminals 3. The male housing 2 has a front end at the right side in FIG. 1. The connector assembly also includes a female connector 4 that is at the left in FIG. 1. The front ends of the connectors 1, 4 can be connected to one another, as shown in FIG. 2. In the following description, the transverse directions of the connectors 1, 4 extend up, down, left, right and obliquely in FIG. 5.

The male housing 2 is molded unitarily e.g. of a synthetic resin, and has a forwardly open tubular receptacle 21 that extends in forward and backward directions FBD along a connecting direction CD of the connectors 1, 4. The male housing 2 also has a terminal mounting portion 22 behind the receptacle 21. The inner peripheral surface of the receptacle 21 is wider at the front than at the back to define a diverging configuration. A lock 21*a* projects up and out from the outer peripheral surface of the receptacle 21 (see FIG. 1).

Each male terminal 3 is formed unitarily by press-working an electrically conductive metal plate and is pressed into a terminal hole (not shown) in the terminal mounting portion 22 from the front. In this way, the male terminals 3 are surrounded at least partly by the receptacle 21 and extend in forward and backward directions FBD.

The female connector 4 includes a female housing 5 and female terminals 6 that are mounted the female housing 5. The female housing 5 is molded unitarily from a synthetic resin and includes a terminal holding portion 51. A holding cap RC also is molded unitarily from a synthetic resin and is mounted before the terminal holding portion 51 so as not to shake. The holding cap RC and the terminal holding portion 51 cooperate to define a terminal accommodating portion. Terminal insertion holes 51*a* are formed in the terminal holding portion 51 and are configured to accommodate the female terminals 6. Terminal holes RC1 are formed in the holding cap RC and align with the terminal insertion holes 51*a* when the holding cap RC is mounted to the terminal holding portion 51. Connection holes RC2 also are formed in the holding cap RC to communicate and align with the terminal holes RC1 and to face the front ends of the female terminals 6 accommodated in the terminal holding portion 51.

Resilient locks 51*b* project from an upper side in the terminal insertion hole 51*a*. The locks 51*b* engage the female terminals 6 inserted into the terminal insertion holes 51*a* to retain the female terminals 6. A retainer TN is mountable to the terminal holding portion 51 and projects at least partly into the terminal insertion holes 51*a*. The retainer TN redundantly locks the female terminals 6 in the terminal insertion holes 51*a*.

The female housing 5 also has a tubular cover 52 that is spaced outwardly from the terminal holding portion 51 so that the cover 52 at least partly surround the terminal holding portion 51. The cover 52 and the holding cap RC cooperate to define an engaging portion. A forwardly cantilevered resiliently deflectable lock piece 53 is formed by cuts in an upper wall of the cover 52 and a lock hole 53*a* is formed near the front end of the lock piece 53. The lock 21*a* of the male housing 2 can engage the lock hole 53*a* to hold the properly connected male and female connectors 1, 4 together. A releasing portion 53*b* is formed at the rear end of the lock piece 53 and can be pressed to resiliently deform the lock piece 53 for separating the connectors 1, 4.

Each female terminal 6 is formed unitarily by press-working an electrically conductive metal plate. The female terminals 6 are crimped, bent or folded into electrical connection with wires WH introduced through waterproof rubber seals RR, and the rear ends of the female terminals 6 also are crimped, bent or folded into connection with the waterproof rubber seals RR. A substantially ring-shaped waterproof seal 7 is formed unitarily from a resilient material (e. g. a synthetic rubber) and is mounted on the female housing 5. Two projections 71 are formed around the outer periphery of the waterproof seal 7 to provide sealing, and an outwardly projecting flange 72 substantially extending is provided at the rear end of the waterproof seal 7. The waterproof seal 7 is mounted on the outer peripheral surface of the terminal holding portion 51 between a rear surface 54 near the rear part of the female housing 5 and the holding cap RC mounted on the terminal holding portion 51.

Figure 3:
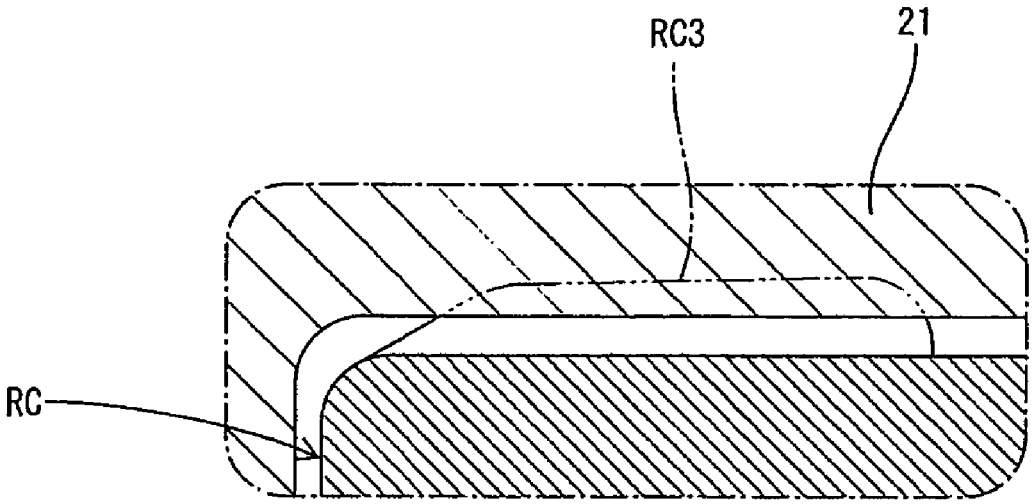
FIG. 3 is an enlarged view of a portion A of FIG. 1.
Figure 5:
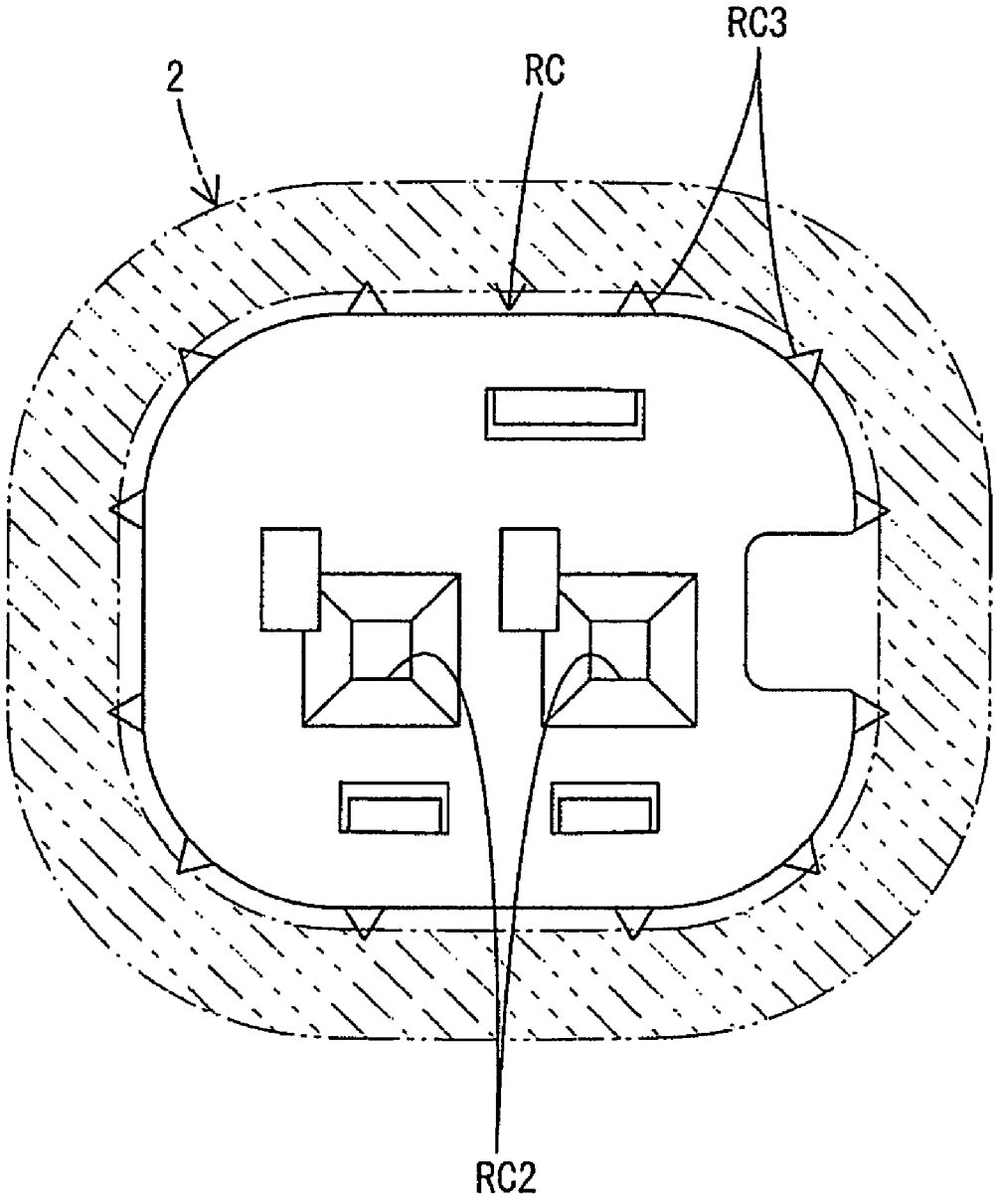
FIG. 5 is a partial left side view of the female connector shown in FIG. 1.

First shake preventing portions RC3 are formed at substantially even intervals around the outer peripheral surface of the front end of the holding cap RC. The first shake preventing portions RC3 project out with substantially triangular converging cross sections, as shown in FIGS. 3 and 5. Second shake preventing portions 52*a* are formed at substantially even intervals around the inner peripheral surface near the rear end of the cover 52 of the female housing 5. The second shake preventing portions 52*a* project in with substantially triangular converging cross sections.

The connector is assembled by inserting the male and female terminals 3, 6 in the respective housings 2, 5. The holding cap RC then is fit on the terminal holding portion 51 of the female housing 5. The housings 2, 5 can be fit together from the front by inserting the terminal holding portion 51 and the holding cap RC mounted thereon into the receptacle 21. The cover 52 simultaneously fits on the receptacle 21. Thus, the male terminals 3 of the male connector 1 are inserted through the connection holes RC2 of the holding cap RC and mate with the female terminals 6 for electrical connection. The lock piece 53 of the female housing 5 slides on the lock 21*a* of the male housing 2 and deforms resiliently up as the connectors are being connected. However, the lock 21*a* of the male housing 2 aligns with and engages the lock hole 53*a* to lock the housings 2, 5 in a fully connected positions, as shown in FIG. 2.

The terminal holding portion 51 engages the receptacle 21 substantially to the rear side thereof as the male and female connectors 1, 4 are connected. Additionally, the projections 71 of the mounted waterproof seal 7 are pressed against the inner peripheral surface of the receptacle 21 to prevent the entry of water or other fluids into the terminal holding portion 51 from the outside. Simultaneously, the leading end of the receptacle 21 presses the flexible flange 72 of the waterproof seal 7 backward and is resiliently engaged therewith. This engagement reduces shaking between the housings 2, 5 in the connecting directions CD and further prevents entry of water across the waterproof seal 7 (see FIGS. 2 and 4).

Figure 4:
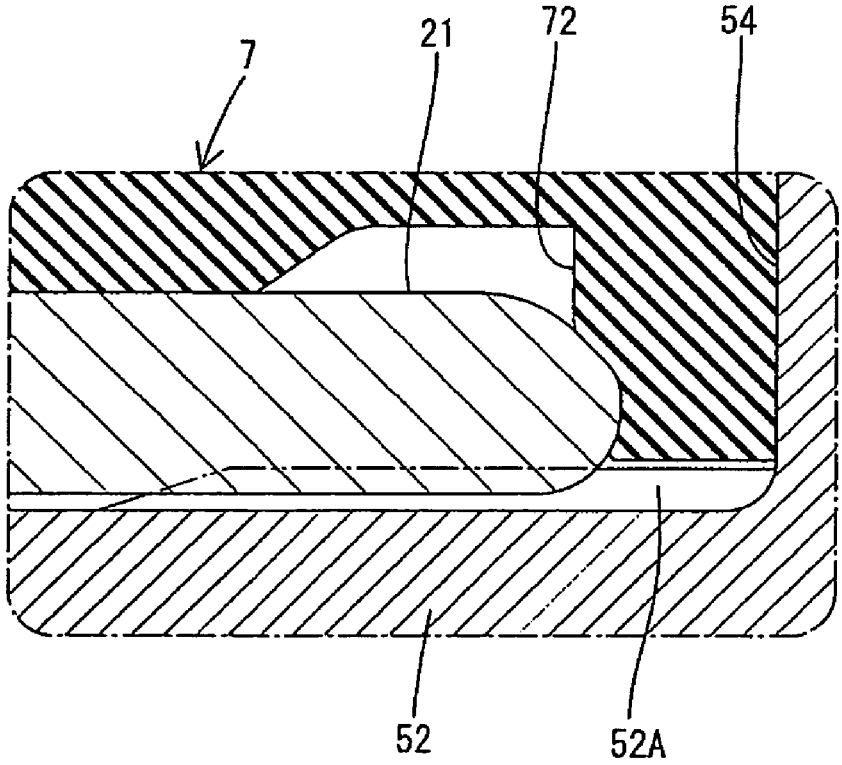
FIG. 4 is an enlarged view of a portion B of FIG. 1.

The receptacle 21 of the male connector 1 telescopes between the holding cap RC and the cover 52 of the female connector 4. Thus, the first shake preventing portions RC3 are between the holding cap RC and the inner peripheral surface of the receptacle 21 at the back of the receptacle 21 (see FIGS. 2, 3 and 5). Additionally, the second shake preventing portions 52*a* are between the cover 52 and the outer peripheral surface of the receptacle 21 at the opening side of the receptacle 21 (see FIG. 2). The outer cross-section of the holding cap RC, including the first shake preventing portions RC3, is slightly larger than the inner cross-section of the back side of the receptacle 21, as shown in FIGS. 3 and 5. Thus, the holding cap RC is inserted into the receptacle 21 while being slightly squeezed. As a result, the receptacle 21 becomes sufficiently strained to eliminate shaking between the holding cap RC and the receptacle 21. Further, the inner cross-section of the cover 52, including the second shake preventing portions 52*a*, is smaller than the outer cross-section of the receptacle 21, as shown in FIG. 4. Thus, the receptacle 21 is squeezed slightly by the cover 52 when the cover 52 is fit on the receptacle 21. As a result, the cover 52 becomes sufficiently strained to eliminate shaking between the cover 52 and the receptacle 21.

As described above, the receptacle 21, the holding cap RC and the cover 52 are engaged with suitable tightening margins to increase rigidity at engaged positions. Thus, the connectors 1, 4 are not deformed even if a load is exerted on the connected connectors 1, 4. Additionally, the tips of the first shake preventing portions RC3 and the second shake preventing portions 52*a* are pressed and squeezed by the receptacle 21 to eliminate shaking of both sides when the receptacle 21, the holding cap RC and the cover 52 are engaged. The first shake preventing portions RC3 and the second shake preventing portions 52*a* are arranged at even intervals around the periphery of the holding cap RC and the cover 52. Thus, a connection load is not increased too much while engaging the holding cap RC and the cover 52 with the receptacle 21, and no problems arise even if the tightening margin is provided between the holding cap RC or the cover 52 and the receptacle 21.

The first shake preventing portions RC3 contact the receptacle 21 near the back side of the receptacle 21 and the second shake preventing portions 52*a* contact the receptacle 21 near the opening of the receptacle 21 when the male and female connectors 1, 4 are engaged to eliminate shaking between the male and female housings 2, 5 in transverse directions. Further, the leading end of the receptacle 21 resiliently engages the waterproof seal 7 to reduce the shaking in the connecting directions CD. Thus shaking between the male and female connectors 1, 4 is reduced in three dimensional directions. Furthermore, the first shake preventing portions RC3 and the second shake preventing portions 52*a* are parts of the rigid holding cap RC and the rigid female housing 5, and therefore are not deformed even if an excessive load acts in a transverse direction between both housings 2, 5. Accordingly, the connected connectors 1, 4 do not shake.

Further, the holding cap RC is inserted into the receptacle 21 and the cover 52 is fit on the outer peripheral surface of the receptacle 21. The first shake preventing portions RC3 are between the holding cap RC and the inner peripheral surface of the receptacle 21 and the second shake preventing portions 52*a* are between the cover 52 and the outer peripheral surface of the receptacle 21 on the mated male and female connectors 1, 4. Thus, a degree of freedom in designing the locations of the first and second shake preventing. portions RC3, 52*a* is increased, and it is possible to provide them in the housing 5 while avoiding interference with the waterproof seal 7.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The first or second shake preventing portions may be formed in or on the receptacle of the male housing.

Overlapping amounts of the first and second shake preventing portions with the receptacle can be determined in consideration of a shaking degree between the connectors, a connection load between the connectors or the like, and these overlapping amounts may be about 0.

Suitable numbers of first and second shake preventing portions can be formed in consideration of a connection load between the connectors.

At the time of connecting the male and female connectors, the leading end of the receptacle may directly contact the female housing without the waterproof seal to prevent the shaking in the connecting directions.

What is claimed is:

1. A connector assembly, comprising:

a first connector having a first housing, the first housing having a receptacle with a rear end and an open front end, inner and outer surfaces being formed on the receptacle and extending between the front and rear ends thereof, at least one first terminal in the first housing and projecting into the receptacle;

a second connector having a second housing with opposite front and rear ends and being formed with an engaging portion, at least part of the engaging portion adjacent the front end of the second housing being fittable into the receptacle of the first housing along a connecting direction, at least one second terminal in the engaging portion and being connectable to the first terminal when the engaging portion is fit into the receptacle of the first housing, the second housing further having a cover configured for telescoping over the outer surface of the receptacle as the engaging portion is fit into the receptacle;

first shake preventing portions projecting outwardly on the engaging portion substantially adjacent the front end of the second housing, the first shake preventing portions being spaced apart along directions transverse to the connecting direction between the first and second housings and engaging the inner surface of the receptacle near the rear end of the receptacle when the engaging portion is fit into the receptacle; and second shake preventing portions projecting inwardly on a surface of the cover facing towards the engaging portion of the second connector at positions substantially adjacent the rear end of the second housing and spaced rearwardly from the first shake preventing portions, the second shake preventing portions being spaced apart along directions transverse to the connecting direction between the first and second housings so that the second shake preventing portions engage the outer surface of the receptacle near the front end of the receptacle when the engaging portion is fit into the receptacle, whereby the shake preventing portions reduce shaking between the housings in transverse directions when the connectors are connected.

2. The connector assembly of claim 1, further comprising a waterproof seal mounted on the engaging portion of the second housing for preventing water penetration into the housings, at least a portion of the waterproof seal being opposed to the second shake preventing portion, the front end of the receptacle pressing a flexible flange of the waterproof seal substantially backward for reducing shaking between the housings substantially along the connecting directions.

3. The connector assembly of claim 1, wherein the first shake preventing portions are substantially equally spaced from one another and wherein the second shake preventing portions are substantially equally spaced from one another.

4. The connector assembly of claim 1, wherein the front end of the receptacle is resiliently engageable with the second connector for reducing shaking between the housings substantially along the connecting direction.

5. The connector assembly of claim 1, wherein the engaging portion has a terminal holding portion insertable into the receptacle.

6. The connector assembly of claim 5, wherein the second shake preventing portions project unitarily in from the cover and define an inner cross-sectional dimension for the cover that is smaller than outer cross-sectional dimensions of the receptacle, whereby the receptacle is squeezed by the cover when the cover is fit on the receptacle.

7. The connector assembly of claim 6, wherein the first shake preventing portions project out from the terminal holding portion and define cross-sectional dimensions slightly larger than inner cross-sectional dimensions at the rear end of the receptacle, whereby the terminal holding portion is insertable into the receptacle while being squeezed.

8. The connector assembly of claim 7, wherein the engaging portion further comprises a holding cap mounted on a front end of the terminal holding portion, the first shake preventing portions projecting unitarily out from the holding cap.

9. A connector, comprising a housing having opposite front and rear ends spaced from one another along forward and backward directions, the housing having an engaging portion with an outer surface and a cover having an inner surface facing the outer surface of the engaging portion, at least one terminal accommodated in the engaging portion of the housing, first shake preventing portions projecting outwardly on the engaging portion and being spaced apart in directions transverse to the forward and backward directions at positions near the front end of the housing, and second shake preventing portions projecting inwardly on an inner surface of the cover and being spaced apart in directions transverse to the forward and backward directions at positions near the rear end of the housing, the second shake preventing portions being spaced rearward of the first shake preventing portions, whereby the shake preventing portions are dimensioned for contacting a receptacle of a mating housing at positions spaced apart along the forward and backward directions when the housing is in the receptacle for reducing shaking between the housings in transverse directions.

10. The connector of claim 9, further comprising a waterproof seal mounted on the engaging portion of the housing for preventing water penetration into the housings, at least a portion of the waterproof seal being opposed to the second shake preventing portion, the seal having a flexible flange for resiliently engaging a front end of the mating housing for reducing shaking between the housings substantially along the forward and backward directions.

11. The connector of claim 9, wherein the engaging portion of the housing has a terminal holding portion formed unitarily with the cover, the terminal holding portion being configured for accomodating the at least one terminal.

12. The connector of claim 11, wherein the second shake preventing portions project unitarily in from the cover.

13. The connector of claim 12, wherein the engaging portion of connector further comprises a holding cap mounted on a front end of the terminal holding portion, the first shake preventing portions projecting unitarily out from the holding cap.

14. The connector of claim 9, wherein the first shake preventing portions are substantially equally spaced from one another.

15. The connector of claim 14, wherein the second shake preventing portions are substantially equally spaced from one another.

* * * * *